US005246176A

United States Patent [19]

Fetzer et al.

[11] Patent Number: 5,246,176

[45] Date of Patent: Sep. 21, 1993

[54] SQUEEZING ROLL MILL

[75] Inventors: Wilhelm Fetzer; Bruno Burkhard, both of Niederuzwil, Switzerland

[73] Assignee: Bühler AG, Uzwil, Switzerland

[21] Appl. No.: 862,354

[22] Filed: Apr. 2, 1992

[30] Foreign Application Priority Data

Apr. 30, 1991 [DE] Fed. Rep. of Germany ..... 4114081

[51] Int. Cl.[5] ..... B02C 4/02

[52] U.S. Cl. ..... 241/226; 15/406; 100/173; 425/225; 425/230; 425/335; 425/363

[58] Field of Search ..... 15/406; 100/70 R, 173; 137/624.14, 624.18; 241/226, 227; 264/175; 425/225, 230, 335, 363, 447, 471, DIG. 235

[56] References Cited

U.S. PATENT DOCUMENTS

| | | | |
|---|---|---|---|
| 3,282,199 | 11/1966 | Mason et al. | 100/173 |
| 3,667,502 | 6/1972 | Otto | 137/624.14 |
| 3,674,389 | 7/1972 | Sturgeon et al. | 425/363 |
| 3,826,280 | 7/1974 | Perham | 137/624.14 |
| 3,910,303 | 10/1975 | Rydberg | 137/624.14 |
| 3,924,652 | 12/1975 | Kah, Jr. | 137/624.18 |
| 4,114,515 | 9/1978 | Pauliukonis | 137/624.14 |
| 4,847,029 | 7/1989 | Dietrich et al. | 425/363 |
| 4,905,917 | 3/1990 | Fetzer et al. | 241/226 |
| 5,102,058 | 4/1992 | Mericle et al. | 241/226 |

FOREIGN PATENT DOCUMENTS

| | | | |
|---|---|---|---|
| 0640052 | 12/1978 | U.S.S.R. | 137/624.14 |

*Primary Examiner*—Scott Bushey
*Attorney, Agent, or Firm*—Martin A. Farber

[57] ABSTRACT

Cleaning means having at least one blast pipe (8) which ensure uniform falling conditions inside return conduits (6) are arranged on a squeezing roll mill (1, 2) having lateral return conduits (6).

23 Claims, 2 Drawing Sheets

SQUEEZING ROLL MILL

FIELD AND BACKGROUND OF THE INVENTION

The invention relates to a roll mill, in particular a squeezing roll mill, having at least two rolls each having an axis of rotation and two end surfaces axially spaced apart, the rolls forming a roll nip in between.

A squeezing roll mill of this type is disclosed, for example, in EP-A-0 271 828. The important feature there is that return con are provided. To enable these to function as return conduits, they must enter above the roll nip, i.e. above the point at which the rolls approach one another most closely. The entry point can be readily chosen so that the bulk material to be squeezed is fed directly into the roll nip. However, in the case of some products it has been found that the entry point is very difficult to choose. The reasons for the particles falling in at different distances from the end surface of the rolls was initially unclear.

SUMMARY OF THE INVENTION

It is therefore the object of the invention to achieve more uniform wear of the rolls by causing the particles to fall into the roll nip at a predetermined distance from the end surfaces of the rolls. This is achieved in a surprisingly simple manner by the invention.

In a first step, the invention starts from the knowledge, gained through investigations, that certain products tend to accumulate or settle in the return conduits, this occurring in particular on the bottom of the return conduits, with the result that the entry point is shifted upward. By arranging at least one cleaning means, it is ensured that the entry point always remains at the same height.

For the purposes of the invention, such a cleaning means may take different forms and may operate in different ways. For example, it is possible to provide for intermittent operation in which brushes, for example with a rotary drive, are dipped into the return conduit from time to time. However, the cleaning means is preferably formed by an arrangement wherein each cleaning device includes at least one blast pipe. In this case, a rigid is in fact easier.

BRIEF DESCRIPTION OF THE DRAWINGS

The invention is described in more detail with reference to schematic drawing, wherein.

DETAILED DESCRIPTION OF THE PREFERRED EMBODIMENTS

Figure 1:
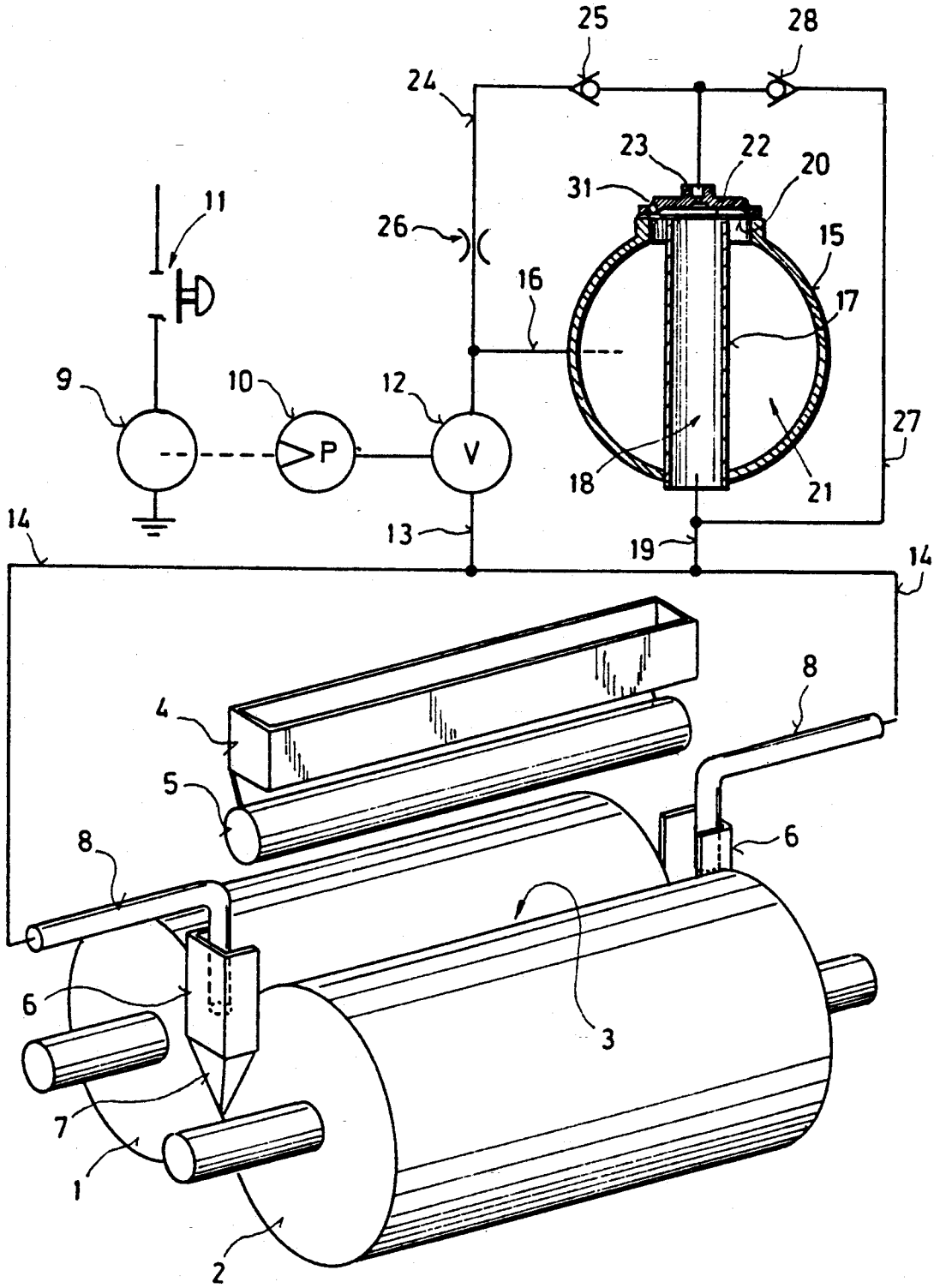
FIG. 1 shows an oblique view of a roll mill with a diagram of an air system for cleaning.

A roll mill according to FIG. 1 has two rolls 1 and 2, one roll preferably being in the form of a fixed roll and the other roll being pressed parallel against it. A roll nip 3, i.e. a gap in which the particles of the product are engaged and squeezed, is formed between the two rolls 1 and 2. A filling box 4 having an internal mixing means (not shown) is provided above the rolls 1 and 2, above the roll nip 3. The bulk material to be treated is fed from the filling box 4 via a feed roll 5 to the roll nip 3.

Return conduits 6 which are channel-like and enter the gap between the rolls above the roll nip with a guiding surface 7 are provided in the middle region between the rolls 1 and 2, at both axial ends of the rolls 1 and 2. By returning the product fed beyond the roll edge, the product feed is made uniform over the roll length and is even slightly increased at the end of the roll, so that excessively low roll wear at the axial ends is avoided.

The product return may be adversely affected by the accumulation of a dirt layer of fine particles of the product in the return conduit 6, in particular on the guiding surface 7. To avoid such soiling, cleaning apparatuses according to the invention are provided for the return conduits. In a special embodiment, at least one blast pipe 8, one end of which enters the return conduit 6, is provided for each return conduit 6. A compressed-air device, preferably comprising a drive 9, a pumping means 10 and a switching means 11 which switches the drive 9 and the pumping means 10 on and off, is provided for supplying the blast pipe 8 with air. By means of a valve 12, one of at least two modes for supplying air to the blast pipe 8 can be set. The simplest mode envisages a direct connection of the pumping means 10 by the valve 12 and conduits 13 and 14 to the blast pipes 8. This mode is used during interruptions in operation and for short times during the operation of the roll mill, in order to eliminate deposits.

Another mode generates, with the aid of a pulsing means, an intermittent flow of cleaning fluid, which prevents the accumulation of fine particles in the return conduits 6 during operation of the rolls. A preferred embodiment of a pulsing means essentially comprises a pressure accumulator 15 which is fed by the pumping means 10 via a conduit 16 and the valve 12. Inside the pressure accumulator 15 is located at least one end of a tube 17 whose other end is closed and whose interior space 18 is connected by the conduits 19 and 14 to the blast pipes 8. That end of the pipe 17 which is located in the pressure accumulator 15 is overlapped by a diaphragm 20 projecting beyond the tube cross-section. The edge of the diaphragm 20 is held in the wall of the pressure accumulator 15, so that the diaphragm 20 divides the pressure accumulator into two spaces 21 and 22. Space 21 is bordered by the inner surface of the wall of the pressure accumulator 15, by the outer surface of the tube 17, said surface being located in the pressure accumulator 15, and by that part of the diaphragm 20 which projects beyond the tube cross-section.

Space 22 is located at that side of the diaphragm 20 which is opposite the tube 17, and serves for applying a contact pressure p1 of the diaphragm 20 on the end of the tube 17. The contact pressure p1 is generated using the air supply from the pumping means 10 via the valve 12, a conduit 24, a choke means 26, a check valve 25 and a pressure supply opening 23 to space 22, and pressure reduction in space 22 by means of a throttling port 31. If the pressure in space 21 increases above a certain value greater than the pressure p1, the diaphragm, owing to its part which projects over the tube cross-section and is under the higher pressure, is lifted so that the spaces 21 and 18 are connected to one another. As a result of this connection, the compressed air pulse passes from space 21 through the interior 18 of the tube, through the conduits 19 and 14 and through the blast pipes 8 into the return conduits 6. The pulse likewise passes through a conduit 27 and a check valve 28 into space 22, where the pressure increase causes the diaphragm 20 to rest against the tube opening and causes a subsequent increase in the pressure in space 21 and thus the beginning of a new pulse cycle.

Figure 2:
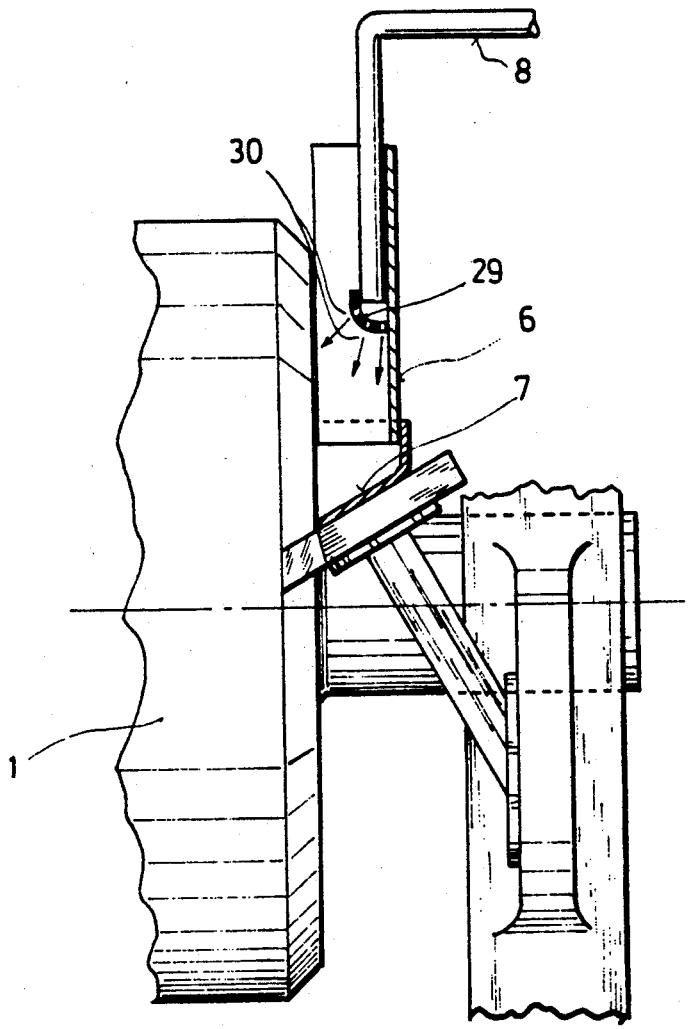
FIG. 2 shows a product return means with a cleaning blast pipe in side view, partly in section.

A special embodiment according to FIG. 2 provides injection endings 29 at those ends of the blast pipes 8 which are located in the return conduits 6. These injection endings 29 have at least one nozzle 30, optionally a plurality of nozzles 30 directed in different directions.

For the purposes of the invention, it is also possible for a blast pipe 8 or an injection ending 29 to be moved along the particular return conduit 6 if this be necessary. Furthermore, the means 15–28 may be modified, for example the diaphragm 20 being subjected to a load by a spring instead of being exposed to pressure through the conduit 27. Of course, it would also be possible to use a correspondingly controlled valve instead of the diaphragm 20 opening as a function of pressure, for example a valve having a manually operated control and/or an electronic control instead of the pneumatic interval control shown.

What is claimed is:

1. Roll mill for milling granular bulk material, said roll mill comprising:

two rolls each having an axis of rotation and two end surfaces axially spaced apart, said rolls forming a roll nip in between;

pressing means for pressing said rolls in the direction towards said nip;

feeding means for feeding said granular bulk material to said nip in such a way that material is fed beyond said end surfaces of said rolls;

guiding means being located adjacent to either of the end surfaces of said rolls for guiding said material being fed beyond said end surfaces back into said nip, said guiding means covering said nip laterally at least in part, and at least one cleaning device for at least one of said guiding means, said cleaning device being located within said guiding means;

wherein each cleaning device includes at least one blast pipe;

said cleaning device comprising pumping means being connected to said blast pipe for supplying said blast pipe with a flow of a cleaning fluid and switching means for switching on and off the fluid flow of said pumping means; and said cleaning device comprising pulsing means for generating an intermittent fluid flow to said blast pipe.

2. Roll mill as claimed in claim 1, further comprising a multi-way valve having at least two positions, in one position said valve connecting said blast pipe to said pumping means.

3. Roll mill as claimed in claim 1, wherein said pumping means comprise air pumping means.

4. Roll mill as claimed in claim 1, wherein said pulsing means comprise shutter valve means having at least two positions, in one position said valve means connecting said pumping means to said blast pipe.

5. Roll mill as claimed in claim 1, wherein said pumping means are directly connectable to said blast pipe to produce a continuous flow of cleaning fluid.

6. Roll mill as claimed in claim 1, wherein said pulsing means include at least one pressure accumulator having an accumulating space connected to said pumping means for building up a pressure of said cleaning fluid and for generating an intermittent pressure flow, an outlet tube having a first end connectable to said accumulating space and a second end connected to said blast pipe, a reference space within said pressure accumulator, the reference space being separated from said accumulating space for building up a reference pressure, valve means for alternately connecting said outlet tube to said accumulating space and for separating the accumulating space from said reference space, said valve means having a first surface exposed to the reference pressure within said reference space, and a second surface opposite said first surface and being exposed to the pressure within said accumulating space, said valve means having an open position and a closed position and assuming the closed position when said reference pressure is higher than the pressure within said accumulating space, in closed position said valve means shutting said outlet tube, whereas said valve means assuming its open position when the pressure within said accumulating space exceeds said reference pressure for connecting said outlet tube to said accumulating space.

7. Roll mill as claimed in claim 6, wherein said valve means comprise a diaphragm having said first and second surfaces.

8. Roll mill as claimed in claim 7, wherein said diaphragm overlaps said first end of said outlet tube with its second surface and extends beyond said outlet tube to be exposed to the pressure within said accumulating space.

9. Roll mill as claimed in claim 6, wherein said reference space includes a throttling port connecting it to the outside of said pressure accumulator to reduce the reference pressure over a predetermined time period, and a pressure supply opening connected to said outlet tube to increase said reference pressure each time the outlet tube is connected to said accumulating space.

10. Roll mill as claimed in claim 9, further comprising a first interconnecting conduit connecting said outlet tube and said pressure supply opening, said first interconnecting conduit comprising a check valve to prevent escaping of said reference pressure.

11. Roll mill as claimed in claim 9, further comprising a second interconnecting conduit connecting said pumping means to said pressure supply opening, said second interconnecting conduit including choke means interposed between said accumulating space and said pressure supply opening, and a check valve to prevent escaping of said reference pressure.

12. Roll mill as claimed in claim 1, wherein said blast pipe includes an injection ending comprising at least one nozzle for directing a flow of cleaning fluid in a predetermined direction.

13. Roll mill as claimed in claim 12, wherein said injection ending comprises a plurality of nozzles, each being directed in a different direction.

14. Roll mill as claimed in claim 1, wherein said roll nip between said rolls is smaller than a particle of said bulk material to allow said pressing means to squeeze said particles by action of a squeezing roll mill.

15. Roll mill for milling granular bulk material, said roll mill including two rolls, each having an axis of rotation and two end surfaces axially spaced apart, said rolls forming a nip in between;

pressing means for pressing said rolls in the direction towards said nip;

feeding means for feeding said granular bulk material to said nip in such a way that material is fed beyond said end surfaces of said rolls;

a conduit located adjacent to either of the end surfaces of said rolls for guiding said material being fed beyond said end surfaces back into said nip; and a cleaning device for the conduit wherein said cleaning device comprises a blast pipe communicating with said conduit, and pulsing means for generating an intermittent fluid flow in said blast pipe.

16. Roll mill as claimed in claim 15, wherein said pulsing means includes means for pumping the fluid; and said pulsing means comprises shutter valve means having at least two positions, of which in one position said valve means connected said pumping means to said blast pipe.

17. Roll mill as claimed in claim 15, wherein said pulsing means includes:

at least one pressure accumulator having an accumulating space connected to said pumping means for building up a pressure of said cleaning fluid and for generating an intermittent pressure flow;

an outlet tube having a first end connected to said accumulating space and a second end connected to said blast pipe;

a reference space within said pressure accumulator, the reference space being separated from said accumulating space for building up a reference pressure;

valve means for alternately connecting said outlet tube to said accumulating space and for separating said accumulating space from said reference space;

wherein said valve means has a first surface exposed to reference pressure within said reference space, and a second surface opposite said first surface and being exposed to pressure within said accumulating space;

said valve means has an open position and a closed position, and assumes the closed position when said reference pressure is higher than the pressure within said accumulating space; and in closed position said valve means shuts said outlet tube, whereas said valve means assumes its open position upon the pressure within said accumulating space exceeding said reference pressure for connecting said outlet tube to said accumulating space.

18. Roll mill as claimed in claim 17, wherein said valve means comprises a diaphragm having said first and second surfaces.

19. Roll mill as claimed in claim 18, wherein said diaphragm overlaps said first end of said outlet tube with its second surface and extends beyond said outlet tube to be exposed to the pressure within said accumulating space.

20. Roll mill as claimed in claim 17, wherein said reference space includes a throttling port connecting it to the outside of said pressure accumulator t reduce the reference pressure over a predetermined time period, and a pressure supply opening connected to said outlet tube to increase said reference pressure each time the outlet tube is connected to said accumulating space.

21. Roll mill as claimed in claim 20, further comprising a first interconnecting conduit connecting said outlet tube and said pressure supply opening, said first interconnecting conduit comprising a check valve to prevent escaping of said reference pressure.

22. Roll mill as claimed in claim 20, further comprising a second interconnecting conduit connecting said pumping means to said pressure supply opening, said second interconnecting conduit including choke means interposed between said accumulating space and said pressure supply opening, and a check valve to prevent escaping of said reference pressure.

23. Roll mill as claimed in claim 15, wherein there is a gap between rolls of the mill, the gap being smaller than a diameter of particles of the bulk material to enable the mill to function as a squeezing roll mill.

* * * * *